US005791398A

United States Patent [19]

Ono et al.

[11] Patent Number: 5,791,398

[45] Date of Patent: Aug. 11, 1998

[54] LOW-PRESSURE CASTING APPARATUS

[75] Inventors: Takahiro Ono, Toyokawa; Toshiyuki Hyodo, Toyohashi, both of Japan

[73] Assignee: Sintokogio, Ltd., Nagoya, Japan

[21] Appl. No.: 674,531

[22] Filed: Jul. 5, 1996

[30] Foreign Application Priority Data

Jul. 7, 1995 [JP] Japan ..... 7-196016

[51] Int. Cl.[6] ..... B22D 18/04

[52] U.S. Cl. ..... 164/306; 164/337

[58] Field of Search ..... 164/306, 309, 164/337, 119, 335

[56] References Cited

U.S. PATENT DOCUMENTS

| | | | |
|---|---|---|---|
| 3,727,674 | 4/1973 | Chatourel et al. | 164/306 |
| 4,153,100 | 5/1979 | Balevski et al. | 164/306 |
| 5,513,690 | 5/1996 | Matsubayashi et al. | 164/306 |

*Primary Examiner*—Joseph J. Hail, III
*Assistant Examiner*—I.-H. Lin
*Attorney, Agent, or Firm*—Limbach & Limbach L.L.P.

[57] ABSTRACT

A low-pressure casting apparatus is provided wherein molten metal can be precisely cast even into a casting mold of a comparatively small capacity, not to mention a casting mold into which a large capacity of molten metal is to be cast, and wherein the casting mold is accurately pressurized. The casting mold, into which a large capacity of molten metal is to be cast, can be cast by connecting at least two crucibles to the casting mold via at least two stalks and at least two connection mechanisms, and by connecting at least two molten-metal holding furnaces to the pressurized-gas supply means via at least two connecting mechanisms, after the pressure chambers of the holding furnaces are made to communicate with each other via the communication mechanisms. A casting mold of a relatively small capacity can also be cast by connecting one of the crucibles to the mold via one of the stalks and one of the connecting mechanisms, and by connecting one of the holding furnaces to the pressurized-gas supply means via one of the connecting mechanisms.

4 Claims, 4 Drawing Sheets

LOW-PRESSURE CASTING APPARATUS

FIELD OF THE INVENTION

This invention relates to a low-pressure casting apparatus wherein molten metal in a crucible is pressurized and cast into a casting mold via a stalk, and more particularly to a low-pressure casting apparatus, which can cast molten metal into a casting mold, into which a large capacity of molten metal is to be cast, as well as a small casting mold, using small-size crucibles.

In a conventional so-called low-pressure casting apparatus wherein molten metal in a crucible is pressurized and cast into a casting mold via a stalk, a molten-metal holding furnace having a large-size crucible, capable of accommodating that capacity of molten metal, has usually been used when a casting mold is cast, into which mold a large capacity of molten metal is to be cast. On the other hand, a relatively small-capacity casting mold has usually been cast also by using the conventional holding furnace having a large-size crucible.

However, when a casting mold of a relatively small capacity is cast by using a holding furnace having a large crucible, there have been harmful effects, which result from frequent changes in the quality of the molten metals, such as troubles to care for molten metals, difficulty in controlling the pressure in the pressure chamber of the holding furnace, extra costs to provide a large apparatus for supplying pressurized gas to the chamber, and inaccurate pressure of the pressurized gas.

SUMMARY OF THE INVENTION

This invention has been devised by considering the above-mentioned circumstances. The purpose of this invention is to provide a low-pressure casting apparatus wherein molten metals can be precisely cast and accurately pressurized even when a small casting mold is used, into which mold a relatively small capacity of molten metal is cast, not to mention a large casting mold, into which a large capacity of molten metal is to be cast.

To achieve the above-mentioned purpose, the low-pressure casting apparatus of this invention, wherein a large casting mold, into which a large capacity of molten metal is to be cast, can be cast as well as a mold of a small capacity, by pressurizing molten metal contained in a crucible, and by casting the molten metal through a stalk into the casting mold, is characterized by a die base on which the mold is mounted, at least two furnaces for holding molten metal, each of which furnaces has a crucible, the capacity of which crucible to accommodate the molten metal is smaller than that of the casting mold, into which a large capacity of molten metal is to be cast, and which crucible is disposed in the furnace, and a pressure chamber, at least two transport cars, which are equipped with elevator means for carrying and moving up and down each of the holding furnaces, and which can move each of the holding furnaces and each of the elevator means to a position just under the casting mold, at least two stalks, mounted on the holding furnaces, for making each of the crucibles communicate with a cavity of the casting mold via a press-contacting mechanism, supply means for supplying a pressurized gas to each pressure chamber of the holding furnaces, at least two connecting mechanisms, detachably mounted on the holding furnaces, for communicably connecting the supply means with the pressure chamber of their respective holding furnaces, and communicating mechanisms for making the pressure chambers of the holding furnaces communicate with one another.

In the apparatus thus constituted, molten metal can be cast into the casting mold, into which a large capacity of molten metal is to be cast, by connecting at least two crucibles to the casting mold of a large capacity via at least two stalks and at least two press-contacting mechanisms, and by connecting at least two holding furnaces to the supply means via at least two connecting mechanisms, after making at least two pressure chambers of the holding furnaces communicate with one another via the communication mechanisms. Further, as for a casting mold, into which a relatively small capacity of molten metal is to be cast, molten metal can also be cast thereinto easily, by connecting one crucible to the casting mold of a relatively small capacity via one stalk, and by connecting one holding furnace to the pressurized-gas supply means via one connecting mechanism.

DESCRIPTION OF THE PREFERRED EMBODIMENTS

Figure 1:
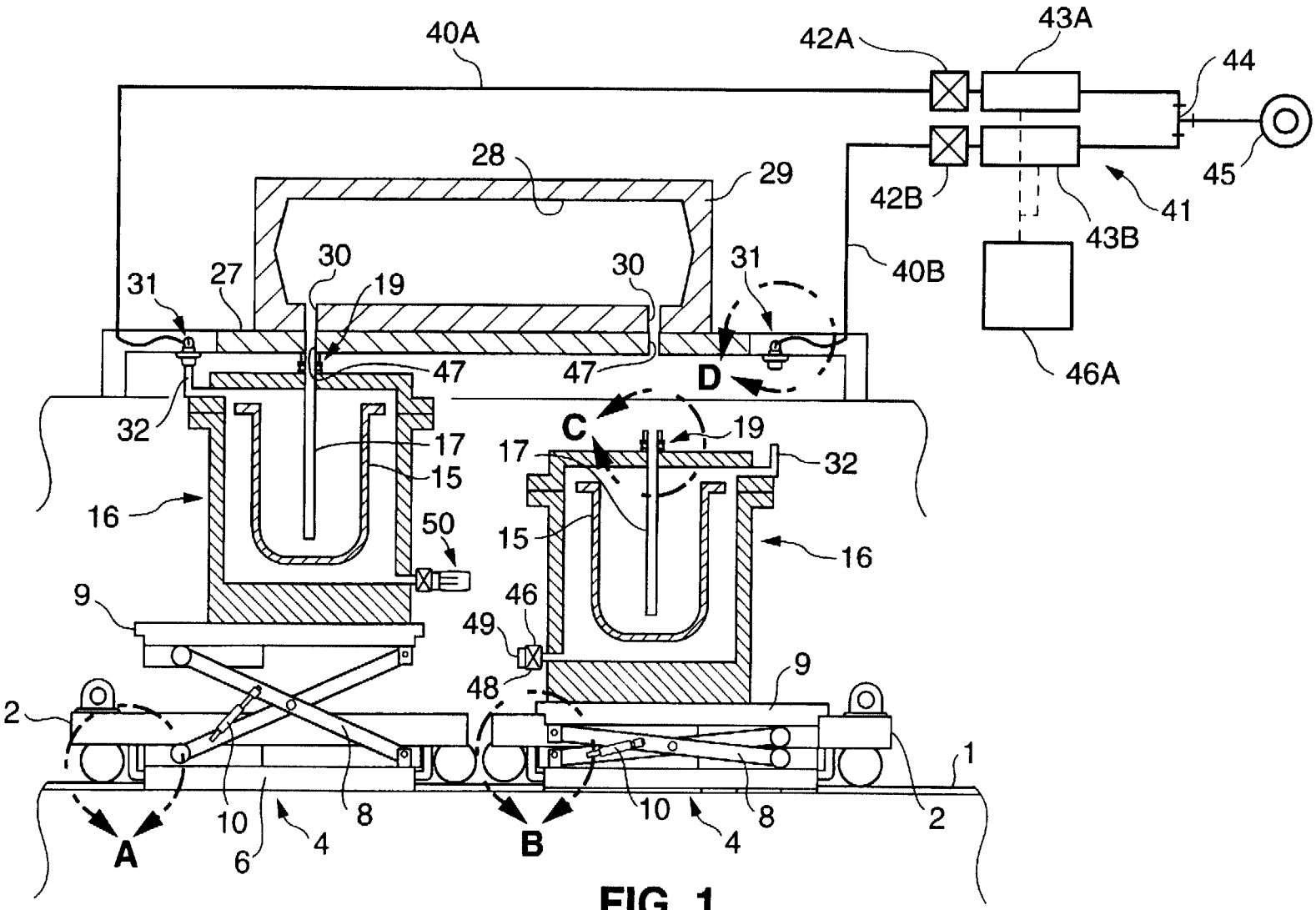
FIG. 1 is a part of a sectional front view showing an embodiment of this invention.

An embodiment of this invention will now be described in detail by reference to FIGS. 1–5. As is shown in FIG. 1, a rail 1 extends in a right-and-left direction on the floor, on which rail 1 two transport cars 2 are movably mounted. On each transport car 2 is mounted elevator means 4 to move a molten-metal holding furnace 16 up and down, which will be referred to below. The elevator means 4 comprises an elevator table 9, which is disposed above the transport car 2 so as to be able to move up and down, and which is carried on the transport car 2 when it goes down, an up-and-down moving member 6, which is mounted on the lower surface of the transport member 2 so that the member 6 can be moved in the vertical direction through four sets of elastic supporting mechanisms 5, two pairs of links 8, which are mounted on the up-and-down moving member 6, and which are constituted such that the links are connected to each other in an X-like shape through a pin to form a pantagraph, such that each of their ends on one side is pivoted on the moving member 6 and the elevator table 9, and such that each of their ends on the other side is fitted in respective wheels, which are mounted movably in a horizontal direction on the moving member 6 and the elevator table 9, respectively, and cylinders 10, which are pivotally provided between two pairs of links 8 such that each cylinder 10 bridges the pair of links 8 so as to widen or narrow the space therebetween. When the cylinder extends, the elevator table 9 is moved up while the up-and-down moving member 6 is moved down to press the floor surface (see FIG. 2), and when the cylinder 10 contracts, the elevator table 9 is moved down while the up-and-down moving member 6 is moved up by the elastic supporting mechanism 5 (see FIG. 3).

Figure 2:
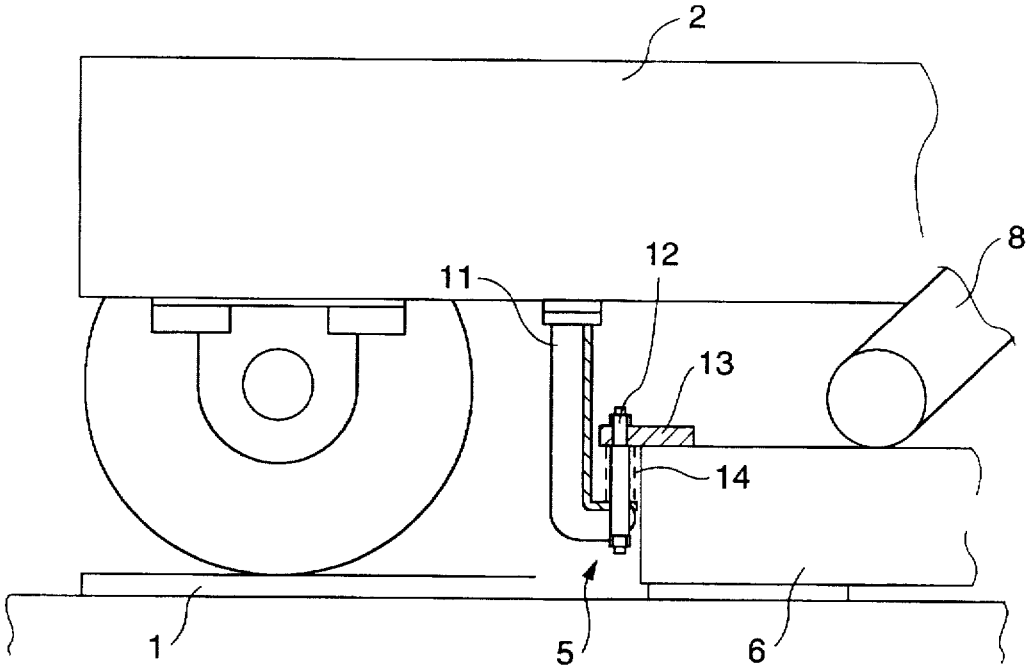
FIG. 2 is an enlargement of part A of FIG. 1.
Figure 3:
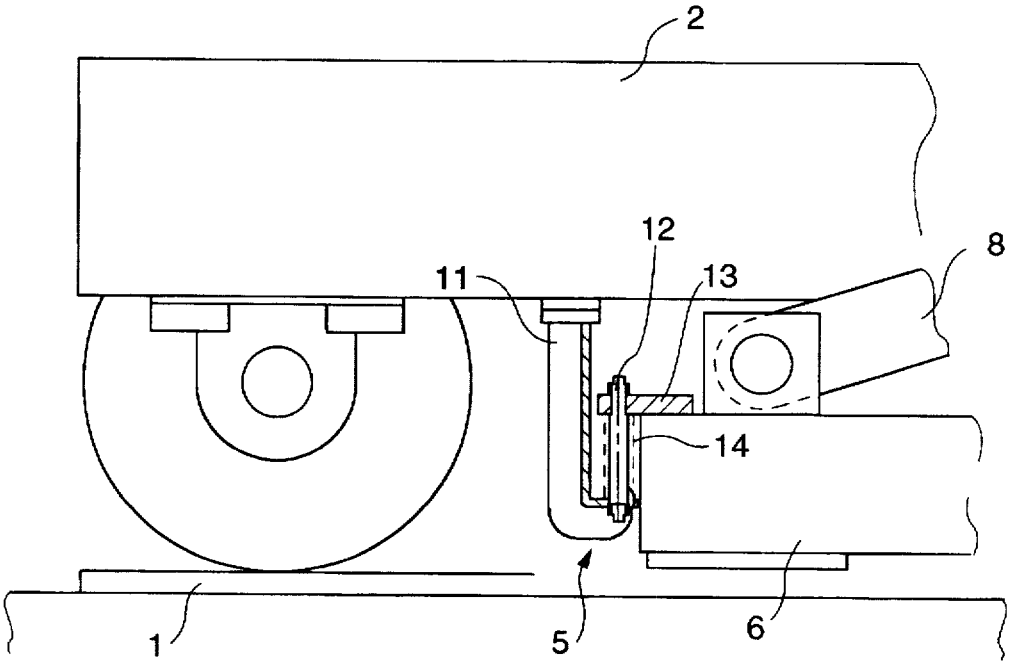
FIG. 3 is an enlargement of part B of FIG. 1.

The elastic support mechanism 5, as shown in FIGS. 2 and 3, comprises a support member 11 of an L-like shape, which is mounted on the lower surface of the transport car 2, a mounting plate 13 fixed to the upper surface of the up-and-down member 6, a support bolt 12, the upper part of which is fixed to the mounting plate 13, the middle part of which is fitted movably up and down in the lower end part of the support member 11, and the lower part of which is prevented from coming out from the support member 11, and a compression coiled spring 14, which is wound around the support bolt 12, and which is interposed between the support member 11 and mount plate 13.

The elevator table 9 carries thereon at least two molten-metal holding furnaces 16, each of which furnaces has a crucible 15, the capacity of which crucible to accommodate the molten metal is smaller than that of a casting mold 29, into which a large capacity of molten metal is to be cast, as will be referred to below, and each of which furnaces has a pressure chamber. Each holding furnace 16 is equipped with a stalk 17, which communicably connects the crucible 15 to the cavity 28 of the casting mold 29, and a press-contacting mechanism 19, which presses the upper part of the stalk 17 against the casting mold 29 with a die base 27 interposed therebetween to make the former contact the latter.

Figure 4:
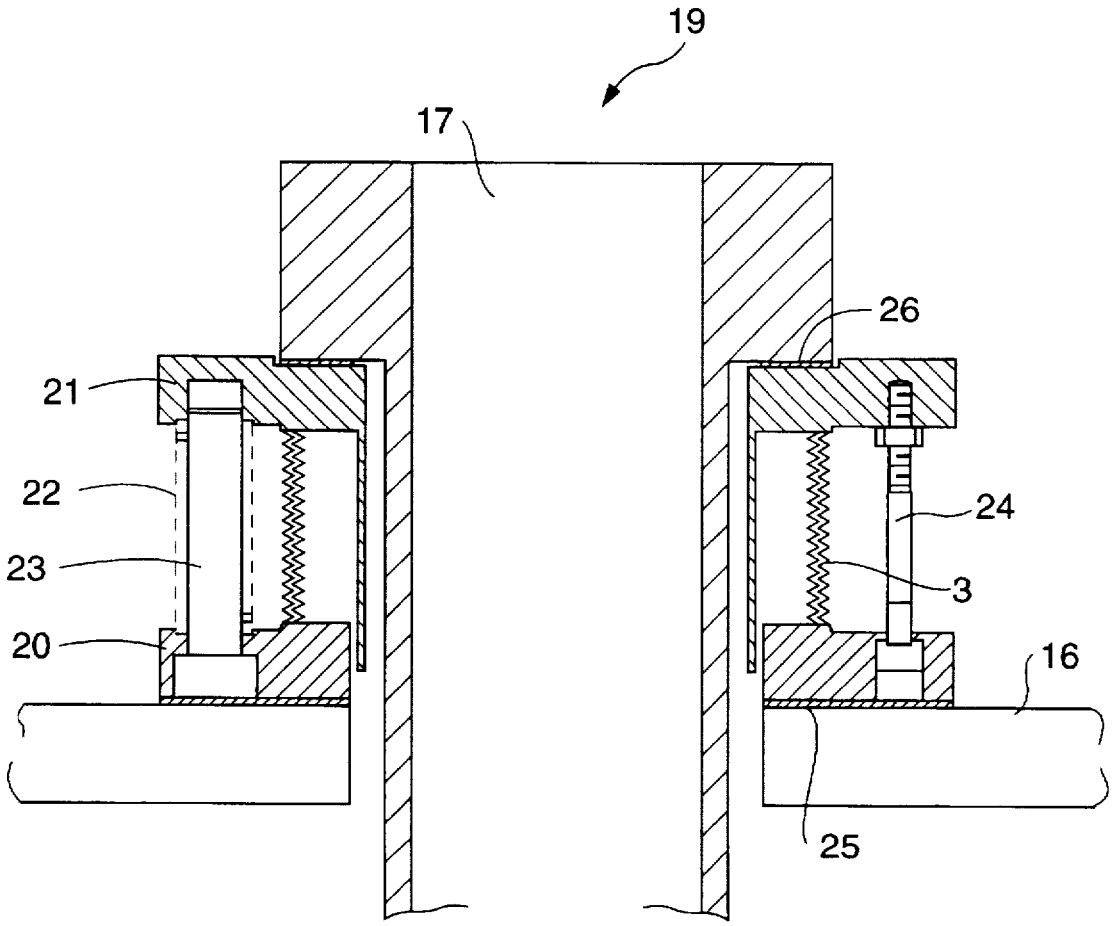
FIG. 4 is an enlargement of part C of FIG. 1.

The press-contacting mechanism 19 shown in FIG. 4 comprises an annular lower seat 20, which is fixed onto the holding furnace 16, and in which the stalk 17 is fitted freely and movably in the up-and-down direction, an annular upper seat 21, which is disposed above the lower seat 20 with a given interval therebetween, and through which the stalk 17 is passed and latched, a compression coiled spring 22 for pressing the upper seat 21 up, a guide pin 23 for guiding the upper seat 21 so that the seat 21 can move up and down, a bolt 24 for holding the upper seat 21 so that the seat 21 can move up and down within a given range, and a flexible, unventilative metal bellow 3, which is disposed between the upper seat 21 and lower seat 20, with seals 25,26 interposed between the holding furnace 16 and lower seat 20 and the upper seat 21 and stalk 17, respectively. The use of the press-contacting mechanism 19 enables the apparatus to easily and precisely mount and detach the stalk 17 on and from the casting mold 29.

As shown in FIG. 1, a die base 27 is disposed above the holding furnace 16, and the casting mold 29, having a cavity 28, into which a large capacity of molten metal is cast, is mounted on the upper surface of the die base 27. The casting mold 29 also has two casting openings 30, which are made to communicate with the stalk 17 via through holes 47 passing vertically through the die base 27.

Figure 5:
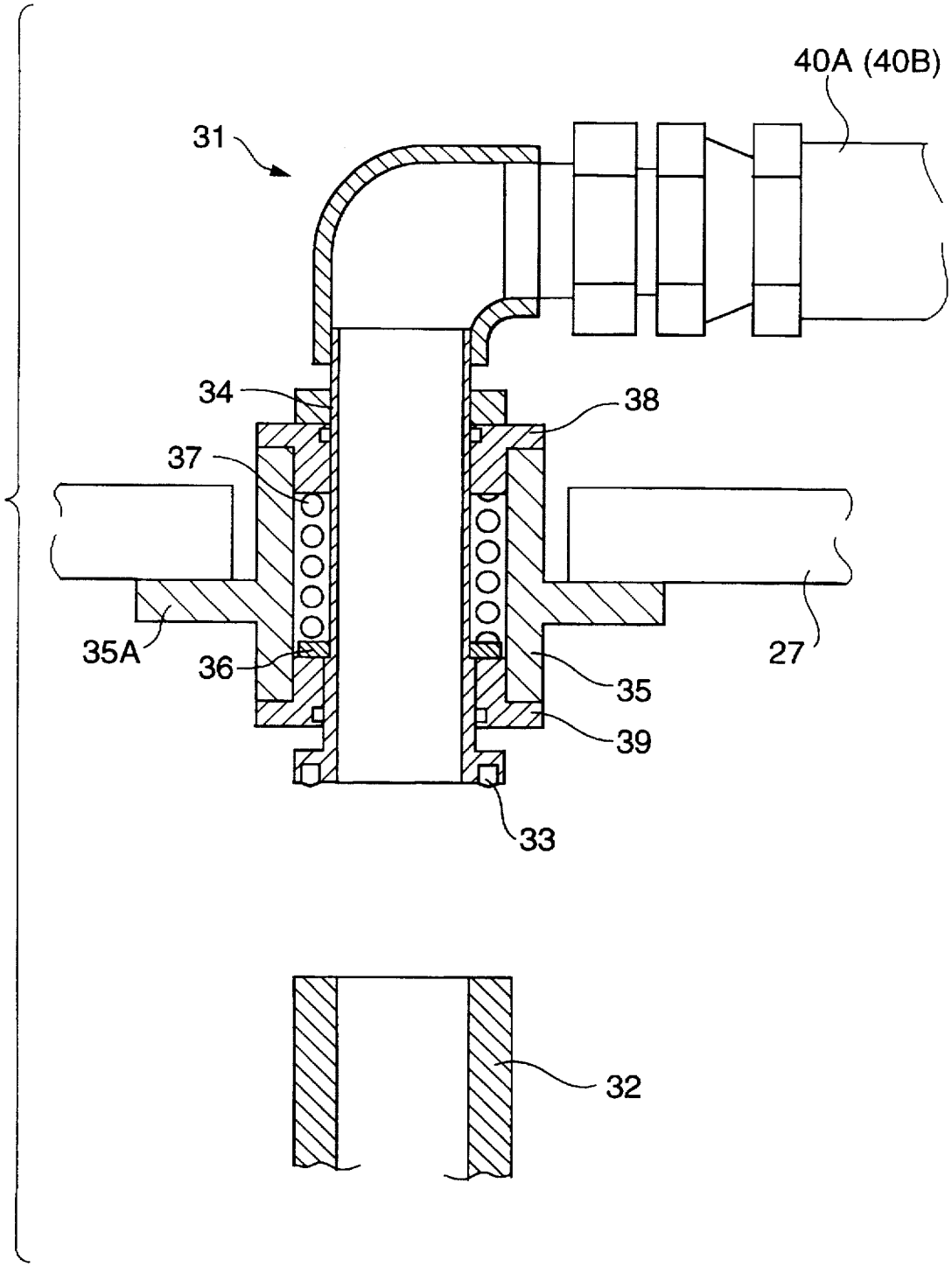
FIG. 5 is an enlargement of part D of FIG. 1.

A connecting mechanism 31, shown in FIG. 1, which connects pressurized-gas supply means 41 to the holding furnace 16, comprises, as shown in FIG. 5, a stationary tube 32, one end of which communicates with the holding furnace 16, and the other end being bent up, a movable tube 34, which extends in the vertical direction, and the lower end surface of which can be moved up and down so that it can be pressed to the upper end surface of the stationary tube 32 to be contacted therewith, with a seal 33 interposed therebetween, a cylindrical supporting member 35, which is fixed to the die base 27 via a flange 35*a*, and in which the movable tube 34 is fitted movably up and down, a compression coiled spring 37 for pressing the movable tube 34 down via a collar 36, upper and lower lids 38,39, mounted on the supporting member 35, for holding the compression coiled spring 37 etc., and flexible piping 40*a*,40*b* for connecting the movable tube 34 to the pressurized-gas supply means 41, which will be referred to below. The connecting mechanism 31 enables the apparatus to easily and precisely mount and detach the pressurized-gas supply means 41 on and from the holding furnace 16.

As shown in FIG. 1, the pressurized-gas supply means 41, which supplies a pressurized gas to each of the pressure chambers of the holding furnaces 16, comprises two electromagnetic open-close valves 42*a*,42*b*, which are connected respectively to the connecting mechanisms 31 via rubber hoses 40*a*,40*b*, two pressure-control valves 43*a*,43*b*, which are connected respectively to the two electromagnetic open-close valves 42*a*,42*b*, a pressurized-gas generating source 45, to which the two pressure-control valves 43*a*,43*b* are connected via a breeches pipe 44, and a controller 46*a* for controlling the pressure-control valves 43*a*,43*b*.

Each of the molten-metal holding furnaces 16 is equipped with a globe valve 46 and an air hole 48, having a tube joint 49. Flexible piping (not shown) is detachably provided between the two tube joints 49. Thus, when the piping is installed therebetween, a communication mechanism 50 is constituted.

The operation of casting molten metal into the casting mold 29 (into which a large capacity of molten metal is to be cast), by using the apparatus thus constituted, will now be described. As shown in FIG. 1, the two holding furnaces 16, having a crucible 15 each, which have accommodated molten metal of equal amounts, are transported to a position just under the casting mold 29; next, the flexible piping is installed between the two tube joints 49; the two globe valves 46 are then opened so as to make the pressure chambers of the furnaces 16 communicate with each other, so that the two chambers have an equal pressure; the two holding furnaces 16 are then moved up by extending respective cylinders 10 of the two elevator means 4, respectively; thereby the two stalks 17 are made to press-contact the lower surface of the die base 27 via the two press-contacting mechanisms 19 so as to make the two crucibles 15 communicate with their respective casting openings 30; simultaneously with this communication the pressure chambers of the two holding furnaces 16 are connected to their respective electromagnetic open-close valves 42*a*,42*b* of the pressurized-gas supply means 41 via the two connecting mechanisms 31; when the cylinder 10 extends, the up-and-down moving plates 6 are pressed against the floor so that the transport cars 2 are fixed onto the floor; now the molten metal can be cast into the casting mold, into which a large amount of molten metal is to be cast, by opening the electromagnetic open-close valves 42*a*,42*b*; the cast molten metal in the cavity 28 is then pressurized while the pressure in the pressure chambers within the holding furnaces 16 is being controlled by supplying a pressure-controlled gas via the pressure-control valves 43*a*,43*b*, controlled by the controller 46; after the molten metal within the cavity 28 has been pressurized, the electromagnetic open-close valves 42*a*,42*b* are closed, and then the two cylinders 10 are contracted so as to move the two holding furnaces 16 down onto their respective transport cars 2, thereby one cycle of the casting operation being completed.

On the other hand, when molten metal is cast into a casting mold of a comparatively small capacity (not shown), a series of casting operations similar to those described above may be carried out after the casting mold is mounted on the die base 27, and after one of the holding furnaces 16 is transported to a position just under the mold by one transport car 2.

EFFECTS OF THE INVENTION

As can be seen from the above-mentioned descriptions, this invention has excellent effects in that molten metal can be easily and precisely cast even into a casting mold of a comparatively small capacity, not to mention a casting mold into which a large capacity of molten metal is to be cast.

What is claimed is:

1. A low-pressure casting apparatus for casting molten metal into a casting mold, into which a large capacity of molten metal is to be cast, in addition to a casting mold of a small capacity, by pressurizing molten metal contained in a crucible, and by casting the molten metal through a stalk into the casting mold said casting apparatus comprising:

a die base on which the mold 29 is mounted, at least two furnaces for holding molten metal, each having a crucible, the capacity of which crucible to accommodate the molten metal is smaller than that of said casting mold, into which a large capacity of molten metal is to be cast, and which crucible is disposed in the furnace, and a pressure chamber, at least two transport cars, which are equipped with elevator means for carrying and moving up and down each of the holding furnaces, and which can move each of the holding furnaces 16 and each of the elevator means to a position just under the casting mold, at least two stalks, mounted on the holding furnaces 16, for making each of the crucibles communicate with a cavity of the casting mold via a press-contacting mechanism, pressurized-gas supply means for supplying a pressurized gas to each pressure chamber of the holding furnaces, at least two connecting mechanisms, detachably mounted on the holding furnaces, for communicably connecting the supply means with the pressure chamber of their respective holding furnaces, and communication mechanisms for making the pressure chambers of the holding furnaces communicate with one another.

2. A low-pressure casting apparatus of claim 1, wherein the elevator means comprises an elevator table, which is disposed above the transport cars so as to be able to move up and down, and which is carried on the transport cars when the table goes down, an up-and-down moving member, which is mounted on the lower surface of the transport member so that the member can be moved in the vertical direction through four sets of elastic supporting mechanisms, two pairs of links, which are mounted on the up-and-down moving member, and which are constituted such that the links are connected to each other in an X-like shape through a pin to form a pantagraph, such that each of their ends on one side is pivoted on the moving member and the elevator table, and such that each of their ends on the other side is fitted in respective wheels, which are mounted movably in a horizontal direction on the moving member and the elevator table, and cylinders, which are pivotally provided between two pairs of links such that the cylinders bridge the pair of links 8 so as to widen or narrow the space therebetween.

3. A low-pressure casting apparatus of claim 1, wherein the press-contacting mechanism comprises an annular lower seat, which is fixed onto the holding furnace, and in which the stalk is fitted freely and movably in the up-and-down direction, an annular upper seat, which is disposed above the lower seat with a given interval therebetween, and through which the stalk is passed and latched, a compression coiled spring for pressing the upper seat up, a guide pin for guiding the upper seat so that it can move up and down, a bolt for holding the upper seat so that it can move up and down within a given range, and a flexible, unventilative metal bellow, which is disposed between the upper seat and lower seat.

4. The low-pressure casting apparatus of claim 1, wherein each of the connecting mechanisms comprises:

a stationary tube, having a first end which communicates with the holding furnace, and a second end which is bent up, a movable tube, which has a lower end surface, an upper end surface, and a seal at the lower end surface, and which extends in the vertical direction, and the lower end surface of which can be moved up and down so that it can be pressed against the second end of the stationary tube to be contacted therewith, with the seal interposed between the second end of the stationary tube and the lower end surface of the movable tube, a cylindrical supporting member, which is fixed to the die base via a flange, and in which the movable tube is fitted movably up and down, an upper lid mounted at an upper end of the cylindrical supporting member, a lower lid mounted at a lower end of the supporting member, a compression coiled spring positioned between the movable tube, the cylindrical supporting member, the upper lid, and the lower lid, for pressing the movable tube down via a collar, and flexible piping for connecting the movable tube to the pressurized-gas supply means.

* * * * *